US007013964B2

(12) United States Patent
Pays et al.

(10) Patent No.: US 7,013,964 B2
(45) Date of Patent: Mar. 21, 2006

(54) HIGH TEMPERATURE HEAT EXCHANGER STRUCTURE

(75) Inventors: Roger Pays, Merignac (FR); Patrick Joyez, Cesson (FR); Clément Bouquet, Bordeaux (FR); Benoît Carrere, La Taillan Medoc (FR)

(73) Assignee: SNECMA Propulsion Solide, Le Haillan (FR)

( * ) Notice: Subject to any disclaimer, the term of this patent is extended or adjusted under 35 U.S.C. 154(b) by 217 days.

(21) Appl. No.: 10/172,358

(22) Filed: Jun. 14, 2002

(65) Prior Publication Data

US 2003/0188856 A1 Oct. 9, 2003

(30) Foreign Application Priority Data

Apr. 9, 2002 (FR) ..... 02 04411

(51) Int. Cl.

| | |
|---|---|
| ***F28F 3/12*** | (2006.01) |
| ***F28F 19/00*** | (2006.01) |
| ***F28F 9/00*** | (2006.01) |
| ***F24H 9/06*** | (2006.01) |

(52) U.S. Cl. ..... 165/168; 165/134.1; 165/53; 165/67

(58) Field of Classification Search ..... 165/168, 165/133, 134.1, 67, 80.4, 53, 48.1, 79; 122/6 A, 122/510, DIG. 13; 138/141, 147
See application file for complete search history.

(56) References Cited

U.S. PATENT DOCUMENTS

| | | | | | |
|---|---|---|---|---|---|
| 1,800,150 | A | * | 4/1931 | Leslie et al. | 165/56 |
| 2,239,662 | A | * | 4/1941 | Bailey | 122/6 A |
| 3,690,103 | A | * | 9/1972 | Dederra et al. | 60/267 |
| 3,710,572 | A | | 1/1973 | Herud | 60/204 |
| 4,188,915 | A | * | 2/1980 | Kummel et al. | 122/6 A |
| 4,275,493 | A | * | 6/1981 | Matovich et al. | 29/454 |
| 4,570,550 | A | * | 2/1986 | Wilt | 122/498 |
| 4,646,500 | A | * | 3/1987 | Smith | 52/506.03 |
| 4,852,645 | A | | 8/1989 | Coulon et al. | 165/180 |
| 5,012,860 | A | * | 5/1991 | Mukherjee | 165/47 |
| 5,183,079 | A | * | 2/1993 | Blin | 138/110 |
| 5,474,123 | A | * | 12/1995 | Buckshaw | 165/134.1 |
| 5,765,600 | A | * | 6/1998 | Newaz et al. | 138/141 |

FOREIGN PATENT DOCUMENTS

| | | | |
|---|---|---|---|
| DE | 33 13 253 A1 | | 12/1983 |
| DE | 199 37 812 A1 | | 2/2000 |
| GB | 273306 | | 11/1927 |
| JP | 2001004101 A | * | 1/2001 |
| WO | WO 98/39612 | | 9/1998 |

* cited by examiner

*Primary Examiner*—Henry Bennett
*Assistant Examiner*—Tho v Duong
(74) *Attorney, Agent, or Firm*—Weingarten, Schurgin, Gagnebin & Lebovici LLP

(57) ABSTRACT

To provide a thermal connection that can withstand mechanical stress in a high temperature structure comprising a panel having one face carrying a circuit made up of tubes in which a fluid flows, the outside walls of the tubes are covered in respective high thermal conductivity textile layers. The structure further comprises holding means for holding the tubes pressed in non-rigid manner against the panel. The structure enables heat exchange to take place between the panel and the fluid in order to cool the panel, to heat the fluid, or indeed in order to do both.

19 Claims, 3 Drawing Sheets

HIGH TEMPERATURE HEAT EXCHANGER STRUCTURE

FIELD OF THE INVENTION

The present invention relates to the field of high temperature structures in which a fluid flows over the wall of a panel.

PRIOR ART

Heat exchanger devices using fluid flow over a panel of a structure subjected to high temperatures are now in widespread use, either for cooling materials subjected to high temperatures, or for heating the fluid, or for both purposes. Thus, with regards to the cooling of materials, although thermostructural composite materials now exist which withstand high temperatures better than conventional materials, they still often need to be cooled because of the temperature levels that are encountered and/or because of the duration of their exposure to such temperatures. In numerous fields, such as the aerospace industry or the nuclear industry for example, there exist heat sources which generate temperatures that are so high that special technology must be used in order to be able to withstand them. The materials which are exposed to these heat sources generally need to be cooled all the time they are in use in order to be able to guarantee a useful lifetime.

Furthermore, heating a fluid by causing it to flow in a hot-walled heat exchanger is a common requirement that is to be found for example in the chemical industry (recovering heat in order to limit energy losses) and in the aerospace industry (heating or decomposing fuel under the effect of heat passing through the wall).

The high temperature structures known in that type of technology comprise firstly a panel for insulating the remainder of the system from the high temperatures that are generated, and secondly a fluid flow device made up of a circuit of tubes placed on the side of the wall facing away from the source of heat. Thus, by maintaining intimate contact between the non-exposed face of the panel and the circuit of tubes, the panel can be cooled and the fluid flowing in the tubes can be heated. To this end, the tubes are fixed to the wall of the panel by brazing or welding, thus enabling contact to be established between the tubes and the panel so as to establish the connection required to exchange heat.

Nevertheless, that type of assembly method presents manufacturing constraints that must be taken into account in order to guarantee that the structure is reliable. It is necessary to ensure continuous contact between the tubes and the panel during the operation of brazing or welding. This implies using tooling serving either to hold the part in place or to apply a compressive force so as to prevent gaps forming due to expansion of the part.

Furthermore, with that type of connection, the resulting device is subjected to high levels of mechanical stress when in use because of the difference between the thermal expansion coefficients of the panel material and of the tube material. The tubes can thus become separated from the wall of the panel, thereby considerably reducing their cooling ability and correspondingly reducing the lifetime of the wall material.

Finally, in that type of embodiment, the connection between the tubes and the panel is permanent and cannot be disassembled, which excludes any kind of repair or maintenance.

In numerous applications, the ability of the panel to withstand high temperatures must be guaranteed with a very high level of safety, given the damage that could be caused in the event of the panel breaking.

OBJECT AND BRIEF SUMMARY OF THE INVENTION

The present invention seeks to remedy the above drawbacks and to provide a high temperature heat exchanger structure that enables high heat conductivity contact to be maintained between the structure and the fluid flow circuit without generating high levels of mechanical stress associated with an embedded connection such as a brazed or a welded connection.

These objects are achieved by a high temperature heat exchanger structure comprising a panel designed to receive high temperature heat flux via one face, with the other face of the panel having a cooling circuit made up of one or more tubes in which a fluid flows, wherein the outside walls of the tubes are covered with a high thermal conductivity textile layer, and wherein said structure further comprises holding means for holding the tubes pressed in non-rigid manner against the panel so as to achieve thermal connection between the tubes and the panel.

Thus, by means of this structure, during large changes of temperature, the internal mechanical stresses generated by the deformation of the materials associated with the differential thermal expansion of the tubes and of the panel are minimized. Contact between the tubes and the panel takes place via the textile layer which allows relative sliding between the tubes and the panel and which can consequently withstand changes in the dimensions of the various elements without breaking the thermal connection between the tubes and the panel.

According to a feature of the invention, the textile layer is made of fibers having high thermal conductivity, such as fibers made of copper or of carbon.

According to another feature of the invention, the textile layer can be in the form of a tubular structure made using braided or knitted textile fibers, or in the form of a tape that is spiral-wound around the tubes.

The textile layer with high thermal conductivity is preferably of a thickness lying in the range 0.1 millimeters (mm) to 0.4 mm. It can also present a fiber content in excess of 30% and a surface coverage ratio greater than 90%.

According to a characteristic of the invention, the holding means comprises one or more cables held under tension against the tubes.

Under such circumstances, the material of the tube-holding cables preferably presents a coefficient of expansion that is less than or equal to that of the panel material.

According to another characteristic of the invention, the holding means comprises one or more spring elements held in compression against the tubes.

The spring elements can comprise metal spring blades shaped to exert compression force on the tubes and optionally also provided with a resilient bearing support placed between the metal blade and the tubes.

Alternatively, the spring elements can comprise at least one metal rod shaped to exert compression force on the tubes.

In order to compensate the local effect of the transmission of the bearing force generated by the above-described holding devices, the tubes can present a small amount of differential bending relative to the wall. During assembly, the tubes are then flexed slightly so as to distribute the compression force more uniformly through the textile layer.

In an embodiment of the invention, the panel has ribs disposed between individual tubes or individual sets of tubes, said ribs including housings to hold the spring elements in compression against the tubes.

Grooves can be provided in the panel in order to form housings for receiving the tubes.

According to a particular feature of the invention, the panel is made of a ceramic matrix composite material and the tubes are made of a metal alloy type material that withstands high temperatures.

The invention also provides a rocket engine nozzle wherein its wall includes a high temperature heat exchanger structure as described above.

BRIEF DESCRIPTION OF THE DRAWINGS

Other characteristics and advantages of the invention appear from the following description of particular embodiments of the invention given as non-limiting examples, and described with reference to the accompanying drawings, in which.

DETAILED DESCRIPTION OF EMBODIMENTS OF THE INVENTION

Figure 1:
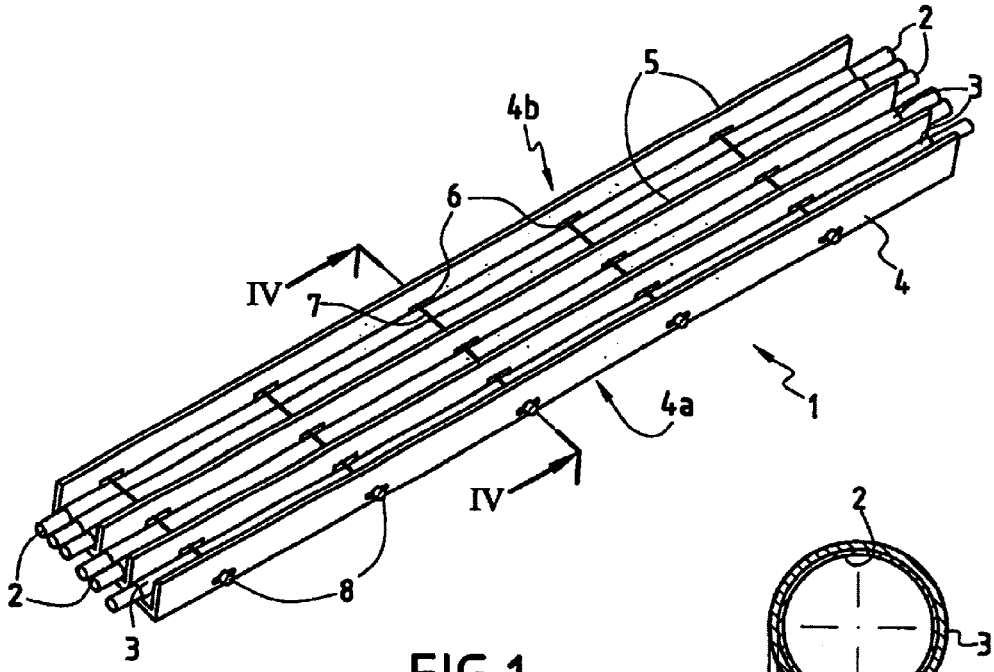
FIG. 1 is a perspective view of a high temperature heat exchanger structure constituting an embodiment of the invention.

The present invention is described in particular with reference to FIG. 1 which shows an embodiment applied to a panel that is to be cooled by the flow of a cooling fluid. Nevertheless, the invention is not limited to a flow of cooling fluid. Thus, the person skilled in the art could easily envisage a similar structure in which the fluid that flows in the wall of the panel is intended to be heated by heat exchange with the panel, since under such circumstances all that changes is the nature of the fluid.

FIG. 1 shows a high temperature structure 1 constituting an embodiment of the invention. The structure 1 comprises a panel 4 that is designed to come into contact via its outside face 4*a* with a source of heat. A plurality of tubes 2 make up a cooling circuit having a cooling fluid that flows therein, these tubes being placed on the inside face 4*b* of the panel 4. The outside wall of each tube 2 is covered in a high thermal conductivity textile layer 3 at least over the entire length of the tube that is common with the panel 4.

Figure 1A:
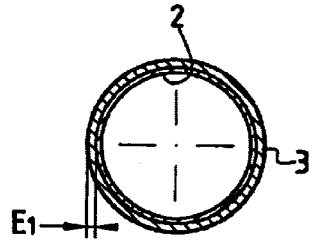
FIG. 1A is a section view of a tube having a high thermal conductivity textile layer in accordance with the invention.

As can be seen in FIG. 1A, which is a cross-section through a tube 2 in a portion that comes into contact with a panel, each tube 2 is entirely covered by the layer 3, which thus forms a sheath of thickness $E_1$ around the tubes.

The layer 3 is made of a textile material which presents high thermal conductivity so as to provide between the tubes and the panel not only mechanical contact of a kind that can accommodate differences in expansion between the materials and other mechanical stresses, but also an effective thermal connection so as to allow the cooling fluid to extract a maximum amount of heat from the panel.

Figure 2:
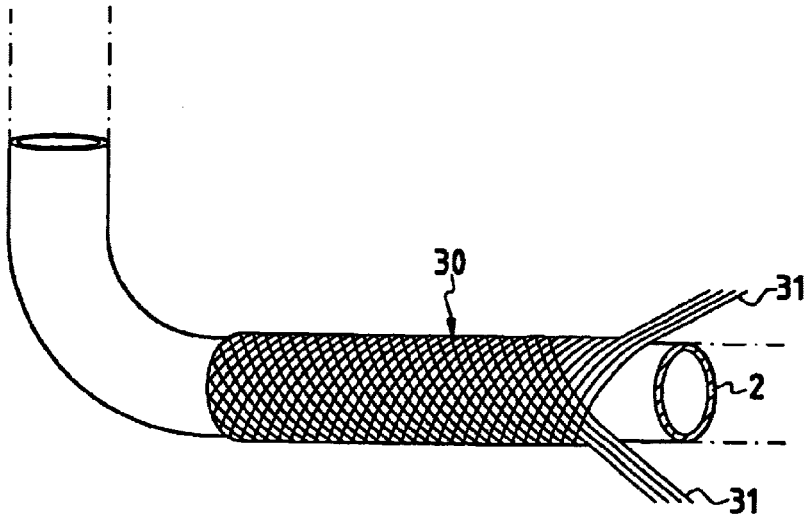
FIG. 2 is a fragmentary diagrammatic view of a tube showing a first type of high thermal conductivity textile layer in accordance with the invention.

The textile layer can be constituted by a tubular structure. FIG. 2 shows one example of how the layer can be made in the form of a tubular braid 30. The braid 30 is made by weaving high conductivity filaments 31 such as fibers of carbon or of copper. The deformability of the braid ensures that good contact is maintained between the tube and the braid. In addition, such a braid can be manufactured industrially and it can be put into place on the tubes, likewise in industrial manner, since it suffices to transfer the braid onto a tube prior to assembling it with the panel. The tubular structure of the textile layer could alternatively be obtained by knitting high conductivity filaments so as to form a sock, which sock can then be fitted onto the tube.

Figure 3:
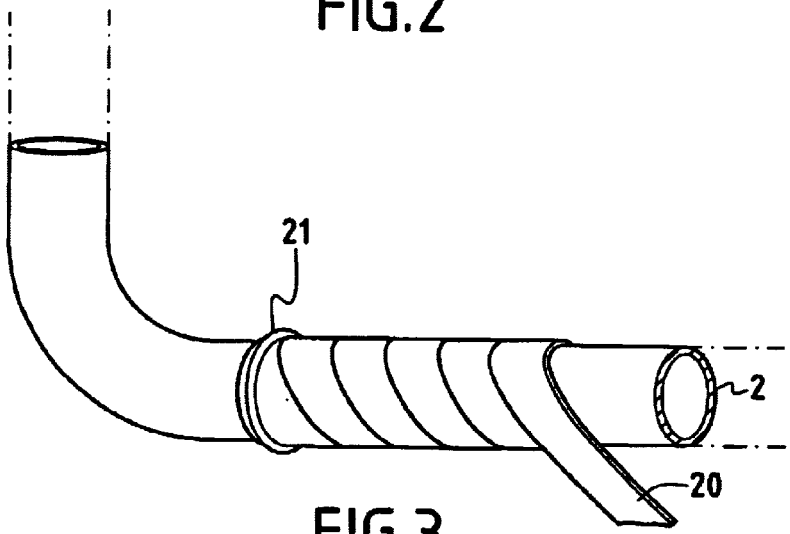
FIG. 3 is a fragmentary diagrammatic view of a tube showing a second type of high thermal conductivity textile layer in accordance with the invention.

In a variant embodiment as shown in FIG. 3, the textile layer which covers the tubes is obtained from a textile strip 20 which is spiral-wound around the tubes and which is fixed at its ends by means of adhesive 21. The strip 20 can then be in the from of a woven cloth, a satin, a felt, a velvet, or indeed a tow or roving.

In general, other materials such as molybdenum, gold, silver, . . . , could be envisaged for constituting the filament or fiber constituting the high thermal conductivity textile.

By way of example, the layer 3 can comprise a textile layer of thickness lying in the range 0.1 mm to 0.4 mm with a fiber content greater than 30%, made of high conductivity filaments such as pitch-precursor carbon fibers treated at very high temperature or filaments of copper, optionally nickel-plated to limit problems of copper oxidizing, and presenting a surface coverage ratio greater than 90%.

An advantage of the present invention is that the textile layer is present all around the tube. Thus, because of the high conductivity of the filaments making up the textile layer, heat from the panel can be distributed all around the tube. Unlike the solution which consists in fixing the tubes to the panel by brazing or welding, the invention serves to increase the heat exchange area between the tubes and the panel beyond the area of the contact that exists between them. The textile layer which has high thermal conductivity serves to make the wall temperature of the tube more uniform, thus enabling heat to be transferred to the cooling liquid more efficiently, even when the tubes are made of a material that is not very conductive, such as a refractory alloy, for example. This is particularly useful when the material selected for the tube needs, in use, to satisfy other constraints such as good high temperature strength, low mass, and ease of shaping, all of which mean that metal materials with high conductivity need to be excluded.

Figure 4:
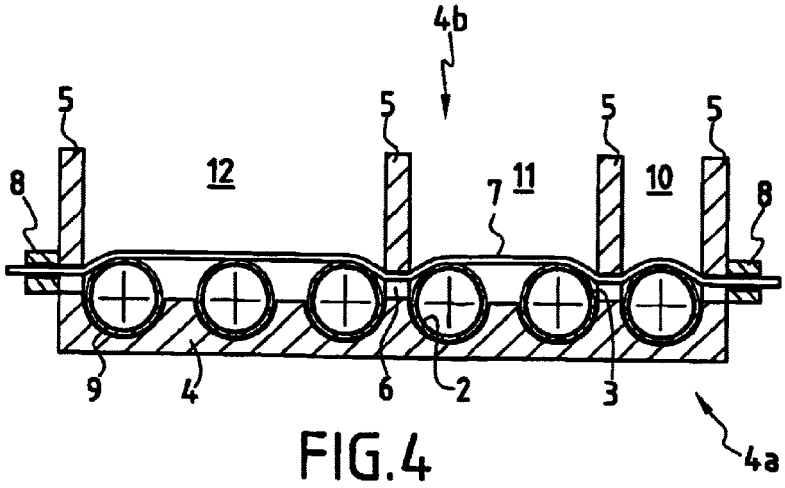
FIG. 4 is a section view on line IV—IV through the high temperature structure of FIG. 1.

Returning to FIG. 1, the inside face 4*b* of the panel 4 also has ribs 5 that act as stiffeners for the panel. The tubes 2 run along the inside face 4*b* between pairs of consecutive ribs 5. Thus, depending on the spacing selected between two consecutive ribs, a space is defined for housing one or more tubes. As can be seen in FIG. 4, the spacing between two ribs can be determined so as to form a space 10, 11, or 12 for housing one, two, or three tubes respectively. In addition, grooves 9 can be formed in the panel 4 for receiving the tubes. Thus, half of each tube can be in contact with the panel through the textile layer 3.

The tubes covered in this way in a textile layer are held in contact with the wall of the panel by holding means that are distributed at points along the panel. The function of the means for holding the tubes in position is to ensure that the assembly holds together by applying forces at various points that tend to press the tubes against the panel so as to guarantee a thermal connection between the tubes and the panel via the textile layer 3.

It is clear that a wide variety of devices could be envisaged for holding the tubes in this way. Nevertheless, the device must be sufficiently flexible or elastic to allow relative movement between the tubes and the panel so as to be able to accommodate the differential expansion of the materials that can take place while the structure of the invention is in use. It is important for a compression force to be transmitted by the holding device against the tubes at all locations in the structure that are liable to be subjected to the expected mechanical and thermal changes, but without that preventing a tube from moving in translation in its groove. Furthermore, in order to compensate for the localized aspect of the way in which the bearing force generated by the above-described holding devices is transmitted, the tubes can present a small amount of differential bending relative to the wall. During assembly, the tubes are therefore flexed slightly so as to distribute the compression force more uniformly through the textile layer.

In the embodiment shown in FIGS. 1 and 2, mechanical contact between the tubes and the panel is maintained by means of cables 7 extending perpendicularly to the tubes. Each cable 7 passes through openings 6 formed in each of the ribs 5 of the panel 4. As shown in FIG. 4, the openings 6 are formed lower down that the tops of the tubes so as to enable the tubes to be pressed against the panel when the cable 7 is tensioned. The cables 7 are held under tension via their ends by retaining members 8 placed on either side of a panel, e.g. crimped ferrules of the type used in the so-called "safety cable" equipment that is commonly used in aviation. Other solutions such as twisting or knotting the ends of the cable could also be applied as means for keeping the cables under tension. When ferrules are used, it is preferable for the ferrules to be made of high temperature, alloy so as to guarantee that crimping holds properly at high temperature. Similarly, in order to ensure that the mechanical tension exerted by the cables on the tubes is retained at high temperature, it is preferable to use a cable made of a material whose coefficient of thermal expansion is not greater than that of the panel material. For this purpose, it is possible to use a carbon or ceramic fiber cable of the kind commonly used for stitching materials that are to be subjected to high temperatures. In addition to its ease of implementation and its compact nature, the device for holding the tubes pressed down by means of a cable presents the advantage of being effective regardless of the number of tubes per panel. It also provides a high degree of accessibility to the panel, making it possible to inspect panel components in non-destructive and low cost manner. With a coefficient of expansion that is less than or equal to that of the panel, the localized forces for holding the tubes that are exerted by the cables 7 remain substantially constant as temperature rises. This ensures that the tubes continue to be held properly in position over a wide range of operating temperatures.

FIGS. 5A to 5D and 6A, 6B show other examples of devices for holding the tubes in position.

FIGS. 5A to 5D show a series of holding devices which are constituted by spring elements bearing against the ribs 5 so as to transmit compression forces on the tubes sheathed in the textile layer of the invention. The ribs need to be machined specifically for each spring element in order to ensure that the spring elements maintain pressure on the tubes. The various spring elements shown in FIGS. 5A to 5D are made up of thin refractory metal sheets or blades, e.g. having thickness lying in the range 0.05 mm to 0.3 mm, that are shaped prior to being installed. The metal is a refractory metal so as to ensure that it retains its elastic properties even at high temperature. The particular material chosen for the spring element depends on the conditions of use such as the operating temperature range, the expected lifetime, or the chemical environment of the surroundings in use.

Figure 5A:
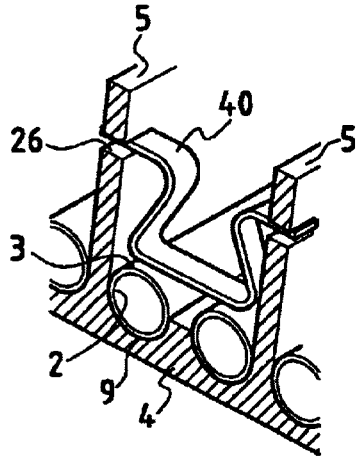
FIGS. 5A to 5D are perspective views showing various embodiments of means for holding the tubes pressed against the panel.

In FIG. 5A, the tubes are held in position by spring elements 40 that are in the form of upside-down omega shapes whose ends are held in housings 26 formed in the ribs 5. Depending on the number of tubes present between two ribs, the shape of each spring element is adapted so as to ensure that a clamping force is maintained on each tube.

Figure 5B:
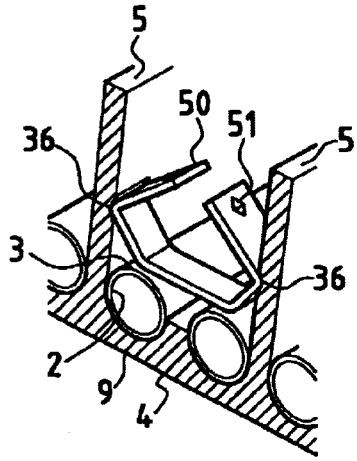
Figure 5C:
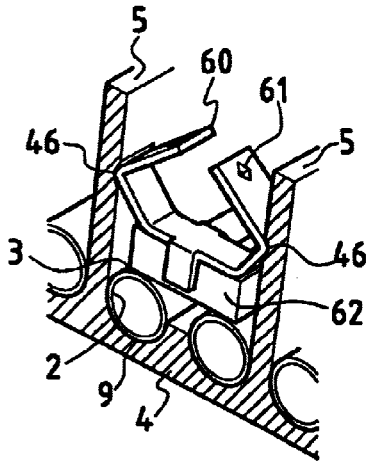

FIG. 5B shows another shape for a spring element suitable for use in exerting contact pressure between the tubes, the textile layer, and the panel. In this example, the spring element 50 is held pressed against the tubes by receiving two folded portions of the blade in cavities 36 formed in the ribs 5 of the panel. FIG. 5C shows a spring element 60 of shape similar to that of FIG. 5B but which also comprises a resilient support block 62 of expanded graphite, for example, for increasing the holding elasticity while restricting vibratory stresses. Holes 51 and 61 can be made through the ends of the spring elements 50 and 60, respectively, so as to make it easier to install them with a pair of pliers.

Figure 5D:
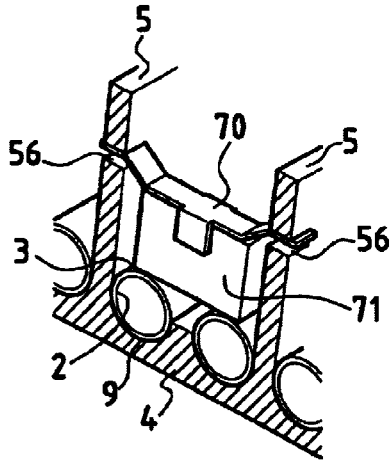

FIG. 5D shows yet another embodiment of a sheet metal spring element. The spring element 70 is in the form of a curved blade having flaps for retaining a resilient support block 71. The spring element 70 is held pressed against the tubes by having its ends received in openings 56 formed in the ribs 5.

Figure 6A:
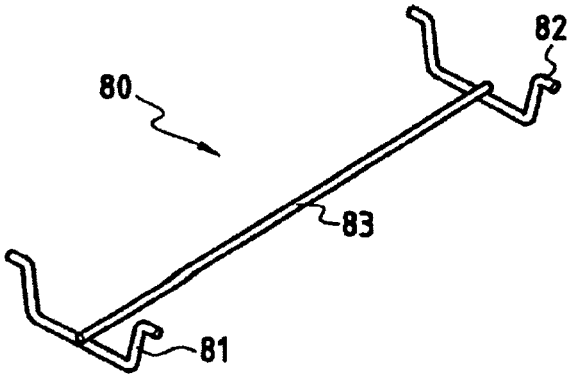
FIGS. 6A and 6B are perspective views showing other embodiments of tube-holding means.
Figure 6B:
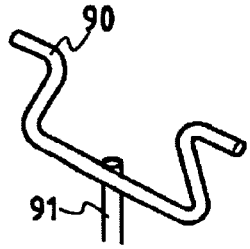

FIGS. 6A and 6B show another type of spring element that makes use of metal rods instead of blades. In FIG. 6A, a holding element 80 comprises two rods 81 and 82 presenting a shape that is close to the shape of the spring element shown in FIG. 5A. The two rods 81 and 82 are interconnected by a rectilinear rod 83. The function of the rod 83 is to prevent the rods 81 and 82 from turning relative to their positioning axes. The rods 81 and 82 are thus prevented from turning individually. FIG. 6B shows a configuration in which a bearing rod 90 has a rectilinear rod 91 welded thereto. In this case, the free end of the rectilinear rod 91 is received in a housing provided in the panel between two tubes.

The spring elements described above perform their function of holding the tubes pressed against the panel by elastic deformation of the metal while they are being put into place in their housings. Consequently, it is preferable for the radii of curvature presented by the various shapes of the spring elements to be relatively long so as to avoid exceeding the elastic limit of the material.

In addition, unlike the cable-holding device described above, each series of spring elements need not be disposed on the same line. This makes it possible to avoid two elements interfering with each other during installation, in particular via the holes made in the ribs.

The above-described holding devices, whether using cables or spring elements, present small mass and size, and these characteristics are often negligible compared with the mass and the size of the panel.

Furthermore, with these devices, the openings or housings formed in the ribs do not need to be very large. The impact of these passages on the structural strength of the panel is consequently minimal and in most cases negligible. The spacing between two holding devices on the panel can be adjusted as a function of the desired holding force. When holding is performed by means of cables, it is possible to place a plurality of cables in a single series of openings. The traction forces in the cables can be controlled so as to avoid subjecting the ribs situated at the ends of the panel to excessive bending.

The material selected for the panel depends on various criteria such as weight, the ability to withstand certain temperatures, and the ability to withstand chemical attack from the source of heat.

The high temperature structure of the invention can be implemented in particular in a cryogenic rocket engine nozzle having a wall that receives and conveys a combustion stream at high temperature. In this type of application, high temperature structures of the invention are used to form the walls of the nozzle. The panels of the structures are made out of a ceramic matrix composite material such as C/SiC or C/C, and together with the tubes they can present one or more bends.

Figure 7:
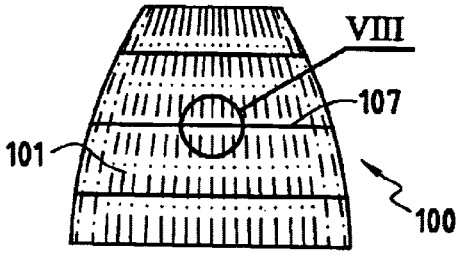
FIG. 7 is a diagrammatic view of a nozzle fitted with a heat exchanger structure of the invention.
Figure 8:
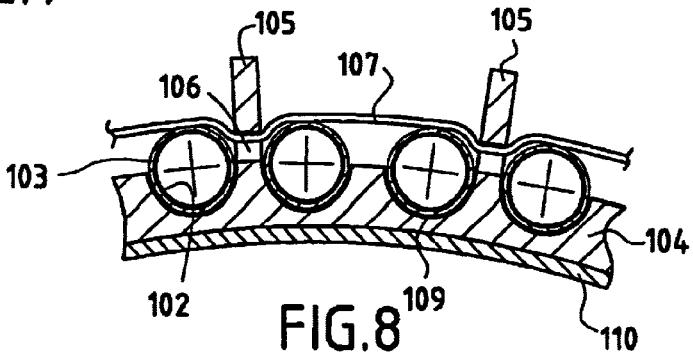
FIG. 8 is a view on a larger scale in cross-section through a detail VIII of FIG. 7.

FIGS. 7 and 8 show an embodiment of the structure of the invention as applied to a rocket nozzle. In FIG. 7, a nozzle 100 is covered on its outside wall by a structure 101 which, in accordance with the invention, comprises a plurality of tubes held in position against a panel by a series of cables 107. The tubes can also be held in position by a series of spring elements as described above. More precisely, with reference to the detail view of FIG. 8, it can be seen that the structure 101 comprises a panel 104 which, unlike the panel 4 of FIG. 1, is curved in shape so as to match the shape of the wall 110 of the nozzle 100. Tubes 102 covered in a textile layer 103 of the invention are uniformly distributed around the nozzle. The tubes 102 are placed in pairs between each pair of stiffeners 105 in grooves 109 that are machined in the panel 104. The fluid flow in the tubes can be used as a fluid for cooling the wall of the nozzle. The fluid can also be a fluid which it is desired to heat by putting it into contact with the nozzle.

In this application, the number of tubes per panel and the length of the tubes can be relatively great (up to 500 3 m tubes per panel). The tubes serve to convey fuel such as liquid hydrogen ($LH_2$). The portion of the nozzle which is formed by the C/SiC structure of the invention operates at a wall temperature lying in the range 1200° C. to 1800° C., while the tubes and the textile layer can reach a temperature of about 800° C. In addition, the system must be capable of withstanding mechanical stresses, in particular vibration, and must optionally be reusable.

In this example, with panels of ceramic matrix composite material such as C/SiC or C/C cooled by a coolant flowing in the wall of the panels via a circuit of metal tubes made of alloys that withstand high temperatures, it has been calculated that given the large heat flux received by the panel, the thermal conductivity of the connection between the tubes and the panel must be greater than 5 kilowatts per square meter per Kelvin ($kW/m^2/K$). The thermal connection between the tubes and the panel as made via the textile layer associated with the holding means of the invention makes it possible to exceed that conductivity while guaranteeing permanent contact even in the presence of mechanical stresses.

The above-described actively cooled high temperature structure can also be used in numerous other applications. In particular, because of its ability to tolerate shock and vibration in the thermal connection that is provided in the structure of the invention, the structure can advantageously be used in the nozzles and combustion chambers of airplane engines and rocket engines. It can also be used in gas turbines or in thermonuclear reactors.

What is claimed is:

1. A high temperature heat exchanger structure comprising a panel designed to receive high temperature heat flux via one face, with the other face of the panel having a cooling circuit made up of one or more tubes in which a fluid flows, wherein the outside walls of the tubes are covered in a high thermal conductivity textile layer, and wherein said structure further comprises holding means for holding the tubes pressed in a non-rigid manner against the panel without threaded attachment to the panel so as to achieve thermal connection between the tubes and the panel.

2. A structure according to claim 1, wherein the textile layer is made of fibers of copper or carbon.

3. A structure according to claim 1, wherein the layer presents a tubular structure made from braided textile fibers.

4. A structure according to claim 1, wherein the layer presents a tubular structure made from knitted textile fibers.

5. A structure according to claim 1, wherein the layer is formed by a tape spiral-wound around the tubes.

6. A structure according to claim 1, wherein the high thermal conductivity textile layer is of a thickness lying in the range 0.1 mm to 0.4 mm.

7. A structure according to claim 1, wherein the high thermal conductivity textile layer comprises a fiber content in excess of 30% and a surface coverage ratio greater than 90%.

8. A structure according to claim 1, wherein the holding means comprise one or more cables held under tension against the tubes.

9. A structure according to claim 8, wherein the cable material presents a coefficient of expansion that is less than or equal to that of the panel material.

10. A structure according to claim 1, wherein the holding means comprises at least one or more spring elements held in compression against the tubes.

11. A structure according to claim 10, wherein the spring elements comprise a metal blade shaped to exert a compression force on the tubes.

12. A structure according to claim 11, wherein said spring elements further comprise a resilient support block placed between the spring blade and the tubes.

13. A structure according to claim 10, wherein the spring elements comprise at least one metal rod shaped so as to exert a compression force on the tubes.

14. A structure according to claim 8, wherein the tubes are slightly differentially curved relative to the panel.

15. A structure according to claim 10, wherein the panel has ribs disposed between one or more tubes, said ribs including housings for holding the spring elements in compression against the tubes.

16. A structure according to claim 1, wherein the panel has grooves forming housings for the tubes.

17. A structure according to claim 1, wherein the panel is made of a ceramic matrix composite material such as C/SiC, C/C, or SiC/SiC.

18. A structure according to claim 1, wherein the tubes are made of a metal material of the type comprising an alloy that withstands high temperatures.

19. A rocket engine nozzle, wherein its wall carries a high temperature heat exchanger structure according to claim 1.

* * * * *